United States Patent [19]

Mayers et al.

[11] 4,211,088

[45] Jul. 8, 1980

[54] INTERNAL COOLING OF HEAT EXCHANGER TUBES

[75] Inventors: Richard R. Mayers, Delta; Steven R. Huebner; Dennis A. Chojnacki, both of Toledo, all of Ohio

[73] Assignee: Midland-Ross Corporation, Cleveland, Ohio

[21] Appl. No.: 969,116

[22] Filed: Dec. 13, 1978

[51] Int. Cl.[2] ..... F17C 7/02

[52] U.S. Cl. ..... 62/64; 134/166 C; 165/184; 432/49; 432/81

[58] Field of Search ..... 165/61, 184; 432/49, 432/81; 62/64, 216; 134/166 C

[56] References Cited

U.S. PATENT DOCUMENTS

| | | | |
|---|---|---|---|
| 3,140,743 | 7/1964 | Cone | 165/184 |
| 3,659,428 | 5/1972 | Kunioka et al. | 62/64 |
| 4,110,092 | 8/1978 | Kunioka et al. | 62/64 |

FOREIGN PATENT DOCUMENTS

| | | | |
|---|---|---|---|
| 2643235 | 3/1978 | Fed. Rep. of Germany | 432/234 |

*Primary Examiner*—Ronald C. Capossela
*Attorney, Agent, or Firm*—Richard A. Negin

[57] ABSTRACT

The present invention is an apparatus and method for cooling heat exchanger tubes at controlled conditions. The apparatus comprises a housing sealingly connected to each heat exchanger tube. There are water and air inlets to the housing. A means to generate mist is located within the housing and directed to spray a jet of mist from the housing into the heat exchanger tube. During operation, air is injected into each heat exchanger tube at controlled conditions. The air is followed by a water mist under controlled flow conditions into each tube. Carrier air accompanies the water mist. A controlled flow of water is injected into each heat exchanger tube after the water mist.

6 Claims, 6 Drawing Figures

INTERNAL COOLING OF HEAT EXCHANGER TUBES

BACKGROUND OF THE INVENTION

This invention is in the field of heat transfer; and more particularly, the invention relates to internal cooling of heat exchanger tubes.

The present invention has particular application in batch coil annealing furnaces. The background of this invention will be more clearly understood by having reference to FIG. 1 which is a sectional view of a batch coil annealing furnace 10 and FIG. 2 which is a sectional view of a base 15 of the batch coil annealing furnace 10. Illustrated in FIG. 1 are metal coils 11 stacked on bases 15 within atmosphere protecting inner covers 12 contained within outer cover 9 of furnace 10.

In the batch coil annealing process for heating a charge of steel coils, the charge is heated according to a predetermined or controlled temperature time relation and then cooled. After the heating, the outer cover 9 is removed from the furnace 10 and the charge is then cooled. In the usual non-accelerated method of cooling, heat from the charge is transferred by convection and radiation to the surrounding inner cover 12. The inner cover in turn loses heat by convection and radiation to its surroundings. Forced convection of the atmosphere within the inner cover is provided by the base fan 19. Enhanced convective heat transfer on the outside of the inner cover can also be provided by fans or fan-type cooling hoods over the inner covers. This cooling method is slow with heat removal from the inner cover being the barrier to heat removal.

The cooling can be accelerated by using a system of heat exchangers located in the base 15 of each stand. FIG. 2 is a sectional view of the base along section 2—2 of FIG. 1. A fan is centrally mounted within the base. Concentrically mounted about the fan are two banks of heat exchanger tubes, such as Intra-Kool ® (trademark registered to Midland-Ross Corporation) heat exchanger tubes, an inner tube bank 20 and an outer tube bank 21. Between the base fan 19 and the inner tube bank 20 are diffuser shape supports 24 and between the two banks of cooling tubes are additional supports, such as the circular supports 25. A deflector ring 22 can be concentrically mounted about the outer tube bank 21.

Heat exchanger tubes, such as Intra-Kool ® tubes for batch coil annealing furnace bases come in standard lengths for the inner tube banks 20 and standard lengths for the outer tube banks 21. All Intra-Kool ® tubes have a $\frac{3}{4}$ of an inch ID. The two of the most widely used tube materials are 316L stainless steel and nickel based alloy 600 (75% nickel, 15% chromium).

During the heating step, the heat exchanger tubes are dry with outside surfaces exposed to hot circulating gas within the inner covers 12. The inside surfaces are exposed to non-circulating air. During the cooling step, air or water is circulated within the heat exchanger tubes. The tubes are not costly to install and provide very rapid cooling, particularly when cooling water is circulated, but the tubes distort badly and crack after several months of operation. If the tubes crack, water from within the tube can damage the charge. Total tube replacement is usually necessary in a short time which can be as short as a hundred heats in extreme cases.

The primary reason for failure of these tubes is thermal shock. Thermal shock as defined means that the temperature gradient across the thickness of the tube wall, around the circumference, or along the length, would produce a thermal stress in excess of the short time yield strength of the tube material.

Rapid cooling cycles used in the past have sent quenching water through the heat exchanger tubing when the tubes were at temperatures above 1300° F. Quench water added at this temperature results in a severe thermal shock and steam formation. This imparts sufficient forces through the tube to cause it to move violently.

In addition to the use of water or air as a coolant in the heat exchanger tube banks, U.S. Pat. No. 3,140,743 by C. Cone discloses a cooling method for use in the heat exchanger tubes in the base of batch coil annealing furnaces. Initially, air is supplied through the tubes until a temperature of about 800° F. At this time the air line is turned off and a water supply is turned on. Cone goes on to suggest that a mist of atomized water can be provided between the air and the water circulation steps of the cooling cycle. Although Cone suggests the use of a mist of atomized water, he does not disclose or suggest how to accomplish the injection of the atomized water. Nor does Cone suggest operating parameters for changes in the different steps going from air to atomized water to water.

One method of introducing water mist into the heat exchanger tubes used in batch coil annealing furnaces has been to first allow the system to cool down to approximately 1000° F. naturally and then add a water mist for a period of about 5 minutes. This is followed by water alone. The method, to date, however, uses one water mist nozzle to supply water mist to a common manifold. The water mist then goes to all of the heat exchanger tubes. This method results in poor mist distribution to individual tubes and within individual tubes.

It is desireable to have an apparatus and a method of operation of cooling heat exchanger tubes, such as Intra-Kool ® tubes, in batch coil annealing furnaces wherein control can be had over the air, mist and water entering each individual tube. Such an apparatus and method is important when considering: thermal stresses along the length, across the walls and circumferentially around the heat exchanger tubes; as well as the more rapid rate of cooling which air, water mist and water will result in when used in heat exchanger tubes.

SUMMARY OF THE INVENTION

The present invention is an apparatus and method for cooling heat exchanger tubes at controlled conditions. The apparatus comprises a housing sealingly connected to each heat exchanger tube. There are water and air inlets to the housing. A means to generate mist is located within the housing and directed to spray a jet of mist from the housing into the heat exchanger tube. During operation, air is injected into each heat exchanger tube at controlled conditions. The air is followed by a water mist under controlled flow conditions into each tube. Carrier air accompanies the water mist. A controlled flow of water is injected into each tube after the water mist.

It is the general object of the present invention to provide a new apparatus and method for cooling heat exchanger tubes, such as Intra-Kool ® tubes, used in the base of batch coil annealing furnaces. Another general object of the present invention is to provide a method of injection of cooling media into a plurality of Intra-Kooled heat exchanger tubes with the flow of the cooling media to each tube controlled. More particularly, it is the object of the present invention to cool a plurality of Intra-Kool® heat exchanger tubes by injecting air, water mist and water into each tube with the flow to each tube controlled.

It is another object of the present invention to inject a carrier air with the water mist controlling both the flow rate of the carrier air and the water mist into each tube. It is another object of the present invention to provide optimum cooling rates with minimum tube stresses by using optimum flow rates of air, water mist and water into each Intra-Kool® tube. It is another object of the present invention to have a control of distribution of mist within each tube. It is another object of the present invention to reduce temperature gradients across the tube wall, along the length of the coil and circumferentially around the tube and thereby minimize corresponding stresses.

It is an object of the present invention to cool the charge rapidly thereby increasing the production over that achieved by conventional cooling. It is another object of the present invention to increase heat exchanger tube life.

It is an object of this invention to obtain one or more of the objects set forth above. These and other objects and advantages of this invention will become apparent to those skilled in the art from the following specification and claims, reference being had to the attached drawings.

DESCRIPTION OF THE PREFERRED EMBODIMENTS

Structure

Figure 1:
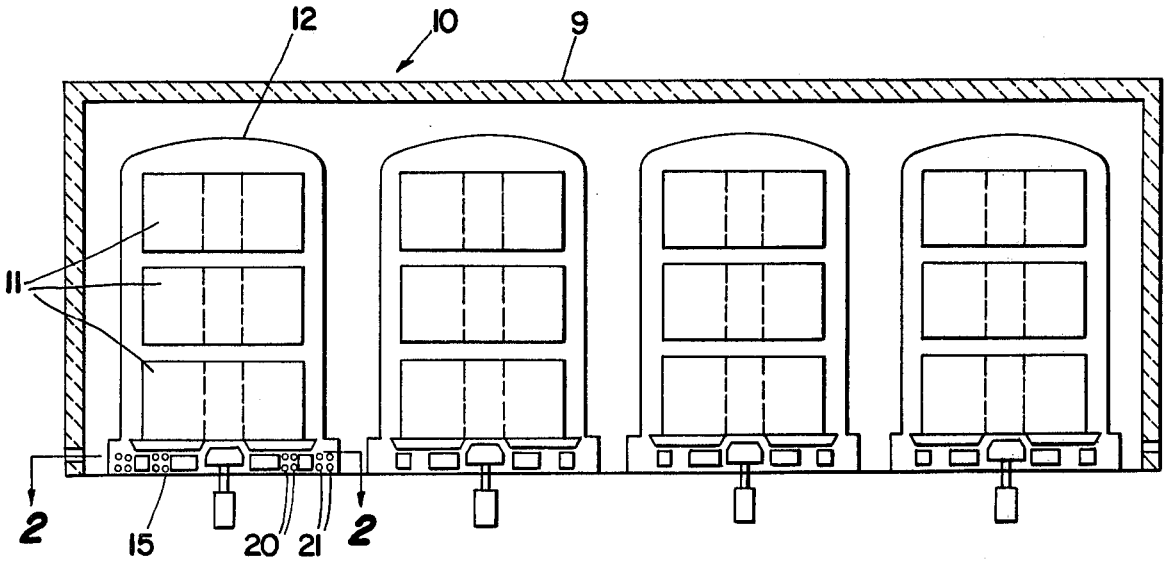
FIG. 1 is a schematic view of a batch coil annealing furnace.
Figure 2:
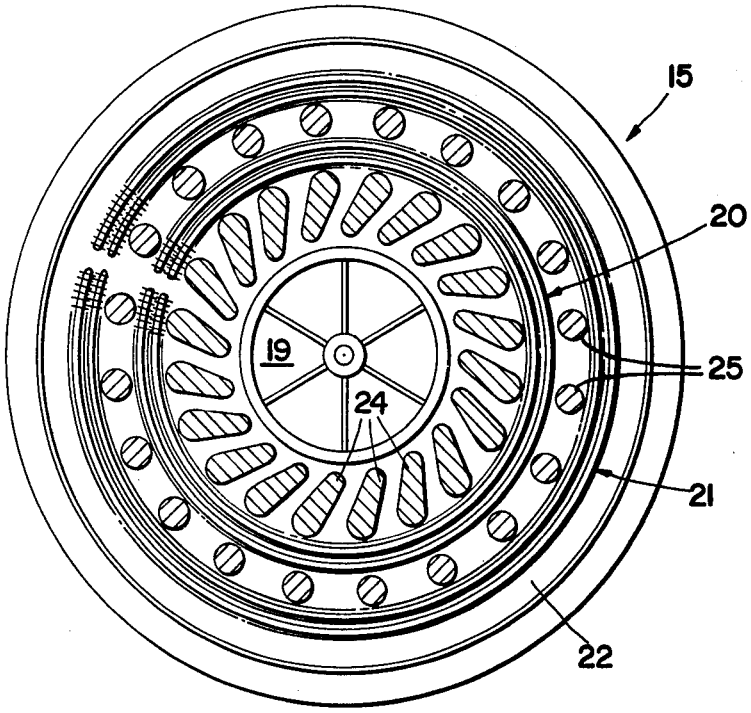
FIG. 2 is a sectional view of a base along lines 2—2 of FIG. 1.

The present invention will be understood by those skilled in the art by reference to FIGS. 1 through 4. The present invention is an apparatus for cooling a heat exchanger tube at controlled conditions. A basic embodiment of the present invention will be described with reference to FIG. 4 which shows a cross-sectional view of the apparatus of the present invention. A housing 31 is sealingly connected to a heat exchanger tube 32. There is a separate housing 31 for each heat exchanger tube 32 in a system which has a plurality of heat exchanger tubes. The housing has a gas inlet 34 and a water inlet 35. A means to generate mist 36 sealingly passes into the housing. A gas line 39 brings a suitable gas such as air to the gas inlet 34. A liquid line 40 brings a suitable liquid, such as water, to the liquid inlet 35 and a mist fluid line 41 brings a fluid used to produce a mist, such as a water mist, to a suitable means to generate mist 36 located within the housing. There can be a housing drain line 37 connected to the housing 31.

Figure 3:
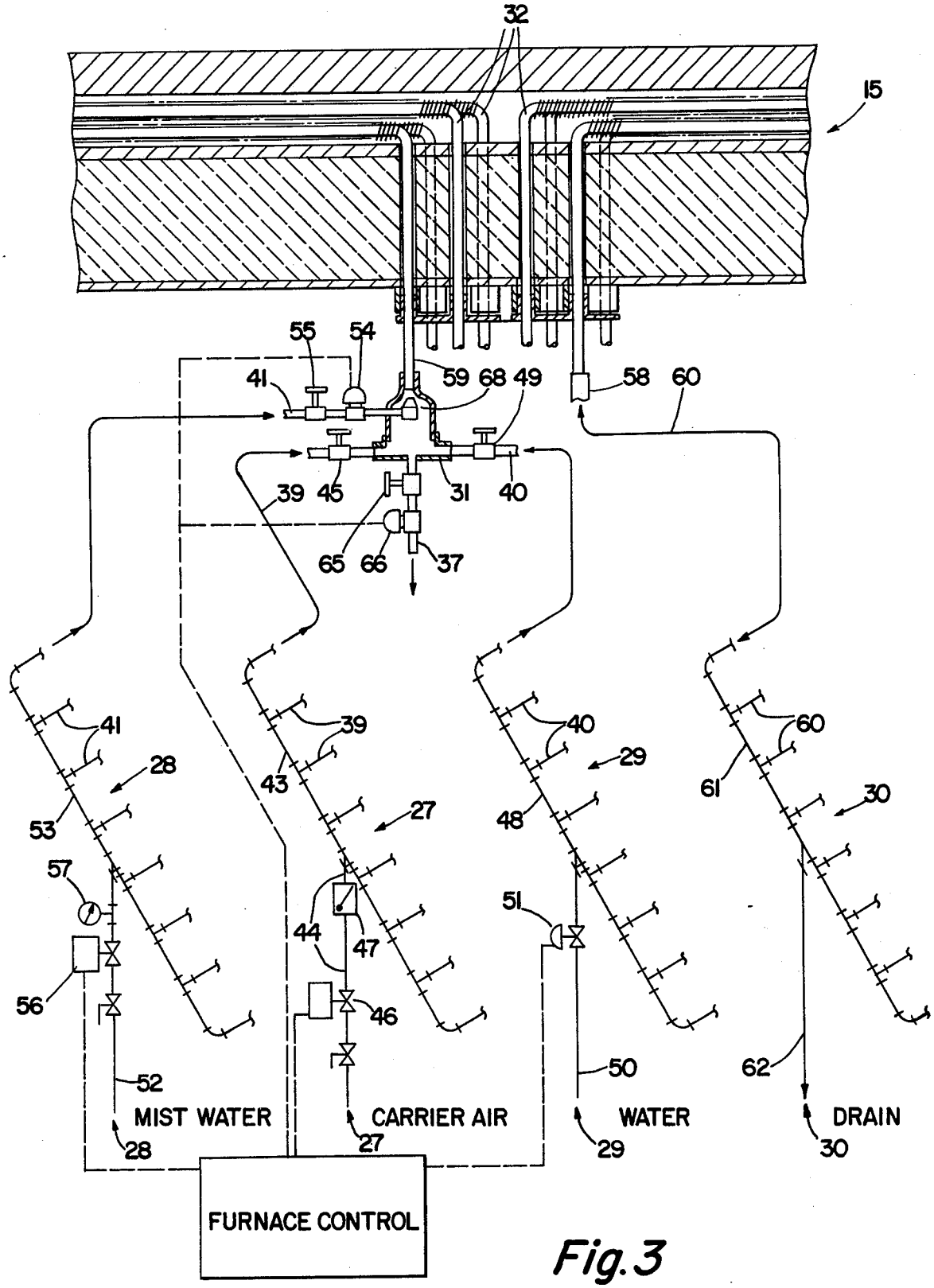
FIG. 3 is a schematic view of the present invention, including the control system and a detailed view of the apparatus connected to one heat exchanger tube in the base of a batch coil annealing furnace.

The means to generate mist 36 can be a pneumatic nozzle or hydraulic nozzle. Both types of nozzles produce satisfactory results. Because the hydraulic atomizer nozzle is easier to operate and requires less piping it is preferred over a pneumatic nozzle. FIG. 3 is an embodiment of the present invention in which the means to generate mist 36 is a hydraulic nozzle.

In the preferred embodiment, the apparatus of the present invention is used with a purality of heat exchanger tubes 32, such as Intra-Kool® tubes, in the base 15 of a batch coil annealing furnace 10. Referring to FIG. 3, a housing 31 is sealingly connected to each heat exchanger tube 32 in the base 15 of a batch coil annealing furnace 10. Preferably, the fluids used are air as the gas, water as the liquid, and a water mist as the mist. In a gas line system 27 which can be used in the present invention, the gas line 39 is connected to the gas inlet 34 of each housing 31. The gas lines 39 can be fed from a common gas manifold 43. In each gas line 39, between the gas manifold 43 and the gas inlet 34, can be a gas line valve 45. A gas feed line 44 feeds gas to the gas manifold 43. Disposed within gas feed line 44 can be a gas control valve 46, such as a motorized valve, which responds to a signal from a furnace control to maintain a controlled gas flow rate. A check valve 47 can be disposed within a gas feed line 44 to prevent damage to upstream equipment should the liquid enter the gas feed line 43.

In a liquid line system 29 which can be used in the present invention the liquid line 40 is connected to the liquid inlet 40 of each housing 31. The liquid lines 40 can be fed from a common liquid line manifold 48. In each liquid line 40, between the liquid line manifold 48 and the liquid inlet 40 can be a liquid line valve 49. A liquid feed line 50 feeds liquid to the liquid line manifold 48. Disposed within liquid feed line 50 is a suitable liquid control valve which responds to a signal from a furnace control to maintain a controlled liquid flow rate. In the preferred embodiment of the present invention used in a batch coil annealing furnace, the valve can be liquid feed line solenoid valve 51.

In a mist fluid line system 28 which can be used in the present invention, the mist fluid line 41 is connected to the means to generate mist 36 in each housing 31. The mist fluid lines 41 can be fed from a common mist fluid manifold 53. In each mist fluid line 41, between the mist fluid manifold 53 and the means to generate mist 36 can be a mist fluid line valve 55 and a mist fluid line solenoid valve 54. The mist fluid line solenoid valve 54 or other suitable valve responds to a signal from a furnace control. A mist fluid feed line 52 feeds mist fluid to the mist fluid manifold 53. Disposed within the mist fluid feed line 52 can be a mist fluid control valve 56, such as a motorized valve, which responds to a signal from a furnace control to maintain a controlled mist fluid flow rate. A pressure gauge 57 can be disposed within the mist fluid feed line 52.

A drain end 58 of heat exchanger tube 32 is opposite the entrance or feed end 59. Fluids being fed into the feed end 59 flow through the heat exchanger tube 32 and are drained out of drain end 58. Drain end 58 can be connected to a suitable drain line system. A suitable drain line system can be any suitable piping arrangement, such as drain line system 30, for efficient drainage without affecting the cooling within the heat exchanger tubes. A preferred embodiment is to have a drain line 60 connected to each drain end 58. The drain lines 60 are all connected to a drain line manifold 61 which leads to a main drain line 62.

The gas line system 27, the liquid line system 29, the mist fluid line system 28, and the drain line system 30 are preferred piping configurations for use with the present invention. It is understood that alternate embodiments of these piping configurations can easily be envisioned and such alternate piping configurations should not limit the scope of the patent to be issued herein.

As noted, each housing 31 can be connected to a housing drain line 37. Disposed within each housing drain line 37 can be a housing drain valve 65 and a housing drain line solenoid valve 66. The housing drain line solenoid valve 66 or other suitable valve responds to a signal from a furnace control. Housing drain line 37 assures that no fluid remains in or near the housing during operation when it is not required.

The means to generate mist 36 is located within the housing and directed to spray axially into the feed end 59 of heat exchanger tube 32. The means to generate mist 36 sealingly passes into housing 31. There is an annular space 68 between the housing 31 and the means to generate mist 36. The mouth 69 of the means to generate mist 36 should be between the heat exchanger tube 32 and the gas inlet 34. Air entering the housing 31 will flow past the mouth 69 of the means to generate mist 36 and entrain the mist coming from the mouth 69 of gas generating means 36 to carry it through heat exchanger tube 32.

Design and Operation

The present invention is a method of injection of cooling media into a plurality of heat exchanger tubes 32, such as Intra-Kool® heat exchanger tubes in the base of a batch coil annealing furnace 10. The operation of the present invention will be described with reference to a batch coil annealing furnace 10, as shown in FIG. 1 with a sectional view of the base shown in FIG. 2, but is not limited to such a furnace. The basic structure and operation of a batch coil annealing furnace is described in the background of the invention. The present invention is concerned with the cooling step in the batch coil annealing furnace 10.

Figure 4:
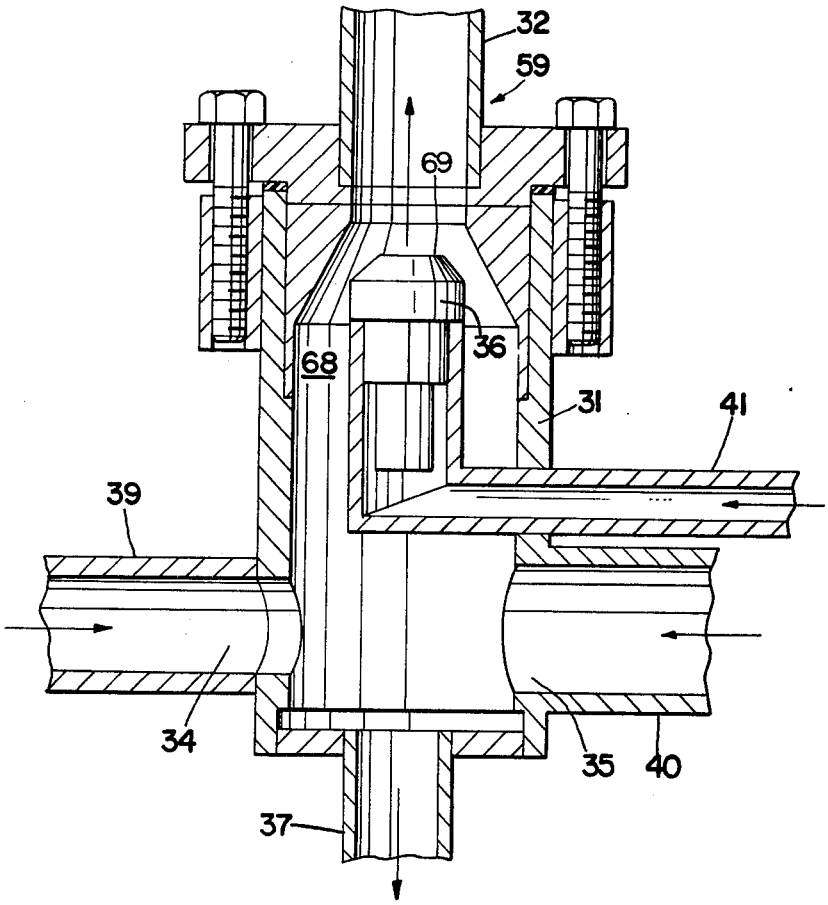
FIG. 4 is a sectional view of one embodiment of the apparatus of the present invention.

During the cooling of the batch coil annealing furnace a cooling media is introduced into the heat exchanger tubes 32 in the base 15 of the furnace 10. The base 15 generally contains two banks of heat exchanger tubes, an inner bank 20 and an outer bank 21. These tubes are standard in the industry. Typically, Intra-Kool® tubes have a known length and an inner diameter of ¾ of an inch. The apparatus as described above is sealingly connected to the feed end 59 of each heat exchanger tube 32 as shown in FIGS. 3 and 4.

During the heating step the heat exchanger tubes 32 generally have stagnant air in them. The tubes reach temperatures in the order of 1350° F., although this temperature is not a limit to the present invention. In the cooling step of the present invention, initially a gas, such as air, is injected into each tube at controlled flow rates and pressures. The air is followed by the injection of a mist, such as a water mist, into each heat exchanger tube 32. The flow rate of the water mist being injected is controlled. The water mist flowing into each tube is carried by carrier air which is fed into the housing 31. Following the water mist step a controlled flow of liquid, such as water, is injected into each tube. The water fills the housing and backs into the air line which can have a check valve which is closed by the water flow preventing water from leaking into the air line.

The control flow rate of the air, water mist and water is important in determining the rate at which the heat exchanger tubes 32 will cool and thereby cool the atmosphere in the inner cover 12.

Preferably, the air is injected at a gradually increasing flow rate. The water mist is then injected into the tube at an increasing flow rate. The flow rate of the water mist and air are controlled to prevent water mist from dropping out of the carrier air stream and forming steam or water pockets. The rates at which the coolants are added control temperature gradients along the axial, circumferential and radial directions within the heat exchanger tubes 32. If the temperature gradients are too high, excessive stresses in the tube can cause their destruction. In addition, stresses in the tube cause violent movement which can also result in damage to the tubes 32.

The preferred conditions for operation of the present invention were determined with a view toward rapid cooling of the coils 11 within the inner cover 12, and extended life of the heat exchanger tubes and particularly the Intra-Kool® heat exchanger tubes 32. The tubes are at a temperature on the order of 1350° F. at the end of the heating step. Air is injected into each tube from 0 to about 2500 standard cubic feet per hour in a period of two minutes. This is followed by water mist injected into each tube from 0 to about 25 gallons per hour in a period of four minutes while maintaining the air flow at about 2500 standard cubic feet per hour. The increase in air flow and in water mist flow is linear. At the end of a total of six minutes, carrier air and water mist flow are stopped and water flow is introduced into the heat exchanger tube 32. The flow rate of the water depends on the temperature as measured by a thermocouple at the drain of the heat exchanger tube 56. The water should not be injected until the tube is cooled by the water mist to a maximum temperature of about 250° F. The carrier air pressure optimumly is at 12 psig. At this pressure a symmetric suspension of the water mist droplets is attained.

Referring to FIG. 3, the following operation sequence can be used to achieve the preferred conditions for operation. Initially there is no flow into heat exchanger tubes 32 which contain stagnant air and are at about 1350° F. Gas control valve 46 controllably opens to allow an air flow rate increase from 0 to about 2500 standard cubic feet per hour after two minutes. Mist fluid line solenoid valve 54 opens and mist fluid control valve 56 controllably opens to allow a mist water flow into the tube from 0 to about 25 gallons per hour in a four minute period while maintaining the air flow at about 2500 standard cubic feet per hour. Pressure gauge 57 monitors the mist water pressure to assure that the proper pressure is used to achieve the desired mist flow for a particular means to generate mist 36, such as a hydraulic nozzle. At the end of a total of six minutes, gas control valve 46, mist fluid line solenoid valve 54 and mist fluid control valve 56 close and prevent further air and mist water flow. Simultaneously, liquid feed line solenoid valve 51 is opened. The water flow rate can be held at a constant value for a given system or vary as desired in response to the temperature measured at the drain line 58. The water flow continues until the desired cooling of the coils 11 is measured by means known in the art.

Testing of air flow, water mist with carrier air, and water flow in Intra-Kool® tubes has shown that effective cooling can be obtained with minimum tube stress using air rates increasing from 0 up to at least 2500 standard cubic feet per hour. Water mist is then injected into each tube from a rate of 0 increasing up to at least 18 gallons per hour while maintaining a suitable carrier air flow rate. A mist flow rate of about 25 gallons per hour is preferred. The carrier air pressure should be at least 10 psig. It should not be below 7 psig otherwise steam pressure formation could cause excessive back pressure and prevent water mist and carrier air flow. After the water mist is injected, water is injected. The flow rate of water depends on the temperature of the water measured at the drain end 58 of the heat exchanger tube 32.

Carrier air pressures have been tested in a range from 3 to 12 psig. When mist is added, steam formation causes a back pressure which prevents carrier air flow below carrier air pressure of 7 psig. Increasing the carrier air pressure above 7 psig allows air flow during mist injection. Pulsing of the carrier air flow is observed which causes some fluctuation of the temperature at the tube outlet. A carrier air pressure of 10 psig is required to eliminate pulsations, and 12 psig is used as a safe operating carrier air pressure.

When water alone is used as the cooling media, relatively large quantities of steam leave the tube as soon as the water valve is opened. This is followed by a slug flow of water from the outlet. Intermittent pockets of steam followed by a slug of water leave the tube with great velocities. Considerable movement of the tube is observed during the two to three second period. Peak pressures recorded at the inlet reach as high as 90 psig. A period of about seven seconds elapses from the instant the water enters the tube to the time the inside of the tube is completely covered with water.

Figure 5:
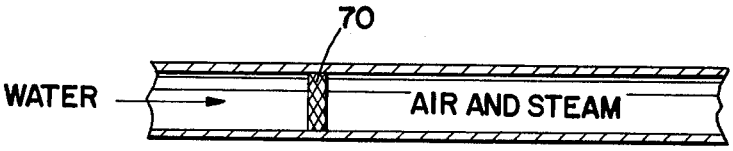
FIG. 5 is a schematic view of a tube with water cooling.

Radial, circumferential and axial gradients occur over a very short period of time during water cooling. Large gradients may occur in 0.1 to 0.5 seconds. The temperature gradients approach the difference between initial tube temperature and the initial water temperature. These large gradients occurring within the tube wall can result in severe stresses which ultimately result in failure or early failure of cooling tubes. There is a band or transition region 70 between the hot and cold portion of the tube, water being upstream, and air and steam from flashed water being downstream, as shown in FIG. 5. Because the transition region is very short with water cooling, temperature gradients within the tube wall are very great as this transition region passes along the length of the tube. For these reasons, there are great stresses in the axial, radial and circumferential directions in Intra-Kool® tubes which are cooled by water alone. There could be as much as a 1000 degree difference across transition region 70.

With mist cooling, air is initially injected into the heat exchanger tube. At optimum conditions as described above, air is injected from 0 to at least 2500 standard cubic feet per hour over a period of two minutes. At this time mist begins to flow, the mist rate increases linearly from 0 to about 25 gallons per minute over a period of four minutes. As the mist flow increases, superheated steam and air first leave the tube. After this phase a mixture of steam, water mist and air leaves the tube. The quantity of mist leaving the exit of the tube increases until the maximum mist flow is reached. At this flow rate, the entire tube is cooled to below about 200° F. At this point the transition is made from mist to water cooling. During the transition period, no water slugs or steam pockets are observed leaving the tube, no additional tube movement or banging is observed.

Figure 6:
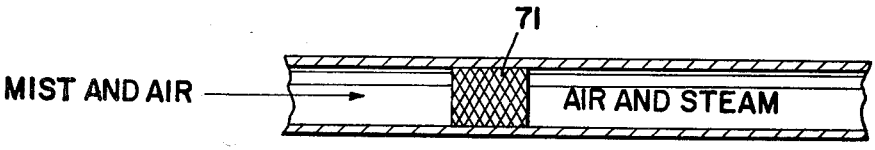
FIG. 6 is a schematic view of a tube with mist cooling.

Radial, axial and circumferential temperature gradients caused by mist cooling are not as great as with water cooling and occur for a longer period of time. A transition zone 71, shown in FIG. 6 analagous to the transition zone 70 in the water injection method, is between the upstream mist and carrier air, and the downstream air and steam from flashed mist. The presence of this band and the fact that the band in the mist cooling method moves more slowly along the tube has been experimentally verified. The fact that it moves more slowly would be evidence that the temperature gradients in the tube wall are less, particularly in the axial direction when using the mist injection method. It is speculated although not yet experimentally verified that band 71 used with mist injection is significantly longer than band 70 used with water injection. This is particularly important when considering the fact that there is a temperature difference of approximately 1000° F. across the length of the band. By having this temperature change spread out over a longer band, temperature gradients in the tube in all directions are significantly reduced and, therefore, stresses in the tube are reduced.

The controlled use of water mist and carrier air results in a symmetric suspension of mist droplets being moved through the tube. The movement and distribution of the mist is dependent not only on the mist nozzle but on the mist nozzle and carrier air. The carrier air flow rate and mist flow rate can be independently controlled. Changes in volume flow of mist can be made with corresponding changes in carrier gas to assure a desired mist distribution with minimum water droplets falling out of the mist onto the tube. The carrier air prevents mist from dropping out on the tube, thereby preventing local steam pockets and subsequent water hammer.

An additional disadvantage to water cooling without the use of mist is that atmospheric collapse can occur within inner cover 12 near the seal between the base 15 and the inner cover 12. Because water cooling produces a sudden reduction in atmosphere pressure near the seal, air on the outside of the inner cover 12 at atmospheric pressure sometimes leaks into the inner cover 12 and damages the coils 11. The initial temperature reduction with the use of mist cooling of the present invention is slower so that the pressure decrease in the inner cover 12 is speculated to be lower. Therefore, the probability of air contamination from outside the inner cover 12 is reduced.

The method of operation of the present invention allows a large range of mist and carrier air flow rates. The temperature gradients in the heat exchanger tube walls are minimized by the use of mist cooling. The use of carrier air with the water mist keeps the mist in suspension with a minimum of water droplets falling out of the mist onto the tube. The use of the present invention minimizes the probability of atmosphere collapse.

Modifications, changes, and improvements to the preferred form of the invention herein disclosed, described and illustrated may occur to those skilled in the art who come to understand the principals and precepts thereof. Accordingly, the scope of the patent to be issued herein should not be limited to the particular embodiments of the invention set forth herein, but rather should be limited by the advance of which the invention has promoted the art.

What is claimed is:

1. A method of injection of cooling media into a heat exchanger tube which comprises:

injecting a controlled flow rate of gas into the heat exchanger tube;

spraying a controlled flow rate of a fluid mist into each heat exchanger tube while maintaining a controlled gas flow rate into the heat exchanger tube;

injecting a controlled flow rate of liquid into each heat exchanger tube.

2. The method as recited in claim 1 wherein:

the gas is air;

the fluid mist is a water mist; and the liquid is water.

3. The method as recited in claim 2 wherein air is injected into the heat exchanger tube at an increasing flow rate.

4. The method as recited in claim 2 or 3 wherein the water mist is then sprayed into the heat exchanger tube at an ever increasing flow rate while maintaining a controlled air flow rate.

5. The method as recited in claim 4 further comprising the steps of:

stopping the air flow and water mist flow; and injecting a controlled flow of water into the heat exchanger tube when the air flow and mist flow is stopped.

6. The method as recited in claim 5 further comprising the steps of:

measuring the temperature of the water leaving the heat exchanger tube;

controlling the water flow rate based on the measured temperature of the water.

* * * * *